United States Patent [19]

Yamasaki et al.

[11] Patent Number: 4,600,086

[45] Date of Patent: Jul. 15, 1986

[54] ELEVATOR HOIST APPARATUS

[75] Inventors: Shinji Yamasaki, Kohnan; Yoshiki Sugiyama, Nagoya; Itsurou Tangiku, Ichinomiya; Yasumasa Iida, Nagoya, all of Japan

[73] Assignee: Mitsubishi Denki Kabushiki Kaisha, Tokyo, Japan

[21] Appl. No.: 712,021

[22] Filed: Mar. 15, 1985

[30] Foreign Application Priority Data

| | | | |
|---|---|---|---|
| Mar. 16, 1984 | [JP] | Japan | 59-51791 |
| Apr. 4, 1984 | [JP] | Japan | 59-67194 |
| Apr. 4, 1984 | [JP] | Japan | 59-67195 |
| Apr. 4, 1984 | [JP] | Japan | 59-49226[U] |
| Apr. 11, 1984 | [JP] | Japan | 59-72156 |

[51] Int. Cl.[4] ..... B66B 11/06

[52] U.S. Cl. ..... 187/27; 187/1 R; 248/680; 242/125.1

[58] Field of Search ..... 187/1 R, 20, 27; 248/680, 679, 500, 505; 52/23, 30; 403/398, 393; 242/106, 117, 125.1; 254/380, 374

[56] References Cited

U.S. PATENT DOCUMENTS

| | | | |
|---|---|---|---|
| 605,937 | 6/1898 | Turner | 187/27 |
| 1,904,863 | 4/1933 | Griffin et al. | 242/125.1 X |
| 1,941,753 | 1/1934 | Plies | 248/680 |
| 2,892,598 | 6/1959 | Dudley | 242/117 |
| 3,590,263 | 6/1971 | Haug et al. | 248/679 X |
| 4,042,066 | 8/1977 | Noone | 187/27 X |

FOREIGN PATENT DOCUMENTS

| | | |
|---|---|---|
| 52-72270 | 5/1977 | Japan . |

*Primary Examiner*—Joseph J. Rolla
*Assistant Examiner*—Nils E. Pedersen
*Attorney, Agent, or Firm*—Leydig, Voit & Mayer, Ltd.

[57] ABSTRACT

An elevator hoist apparatus of the type disposed in the bottom of a hoistway has an improved structure for securing the apparatus to the wall of the hoistway. The apparatus also comprises an improved hoist drum having multiple parallel rope grooves formed in the drum so as to spiral around the drum in the same direction from one end of the other to the other. The load acting on the main ropes wrapped around these grooves is thereby equalized, increasing the safety of the apparatus. Furthermore, the ends of the main ropes are secured to the drum so that the main ropes are reliably secured even when there is no tensile force acting on the main ropes.

8 Claims, 22 Drawing Figures

ELEVATOR HOIST APPARATUS

BACKGROUND OF THE INVENTION

The present invention relates to an elevator hoist apparatus, and in particular to a hoist apparatus disposed in a machine room at the bottom of an elevator hoistway which has an improved means for securing the hoist apparatus to the wall of the hoistway as well as an improved hoist drum.

FIG. 1 illustrates a conventional elevator apparatus of the type in which a hoist apparatus is disposed in an machine room near the bottom of an elevator hoistway. In the illustration, an elevator hoistway 1 has a machine room 2 provided at its lower end just above the pit 1*a* of the hoistway 1. In the machine room 2, a hoistway apparatus is provided which comprises a hoist 4, a base 3 on which the hoist 4 is mounted and which is secured to the floor 2*a* of the machine room 2, and means, comprising elements number 8 through 11, for rigidly attaching the end of the base 3 to the wall of the pit 1*a* just below the machine room 2. The hoist 4 comprises an unillustrated motor, an unillustrated reduction gear driven by the motor, and a hoist drum 4*a* which is mounted on the output shaft of the reduction gear. The hoist drum 4*a* has a plurality of main ropes 7 wrapped around it which pass over a deflector sheave 6 disposed in the top of the elevator hoistway 1 and connect to the frame 5*a* of an elevator car 5 which is suspended from the main ropes 7 and which travels up and down the hoistway 1.

As shown most clearly in FIG. 3, the base 3 comprises a plurality of horizontal beams 3*a* which are secured to the floor 2*a* of the machine room 2 by suitable unillustrated means such as anchor bolts and which each have one end secured to the wall of the hoistway 1 by the above-mentioned attaching means comprising elements numbers 8 through 11. Element number 8 is a metal securing plate which is bolted to the wall of pit 1*a* by fixtures 9 comprising nuts and anchor bolts or the like. The top end 8*a* of the securing plate 8 is bent outwards into the elevator hoistway 1 and is secured to the base 3 by fixtures 11 comprising nuts and bolts or the like which pass through holes formed in the beams 3*a* and corresponding holes formed in the top ends 8*a* of the securing plate 8. Elements number 10 are metal connecting plates which have their bottom ends secured to the sides of the securing plate 8 by welding and which have their upper ends secured to the ends of the base 3 by fixtures 11 comprising nuts and bolts or the like. Thus, the base 3 on which the hoist 4 is mounted is secured to the securing plate 8 which in turn is secured to the wall of the pit 1*a* of the hoistway 1 just below the machine room 2.

This means for securing the hoist 3 to the wall of the pit 1*a* of the hoistway 1 has the following disadvantages. First of all, because the top ends of the connecting plates 10 are secured to the ends of the base by bolts, the ends of the base 3 must protrude into the hoistway by a length A in order to provide sufficient strength and to provide enough space for the manipulation of tools when installing the bolts. In this hoist apparatus, the length A can not be significantly reduced, and it is thus difficult to install a hoist apparatus of this type in a narrow hoistway. Another problem is the large number of fixtures which are necessary to connect the base 3 to the securing plate 8. Furthermore, as shown in FIG. 3, the width $A_1$ of the base 3 must just equal the width of the securing plate 8, and the distance $A_2$ between the holes formed in the top ends 8*a* of the securing plate 8 must just equal the distance between the corresponding holes for the fixtures 11 formed in the beams 3*a* in order for the securing plate 8 and the beams 3*a* to be properly connected to one another. The manufacture of the base 3 and the plate 8 therefore requires considerable precision and the connection of the base 3 to the securing plate 8 is difficult.

A more serious problem relates to the use of a single large securing plate 8 for securing the base 3 to the wall of the pit 1*a* of the hoistway 1. This problem is illustrated in FIG. 4, which is a view of the hoist apparatus of FIG. 3 taken along Line II—II. The wall of the pit 1*a* of the hoistway 1 is generally made of concrete, and in most cases is not perfectly smooth. A wide securing plate 8 which spans the entire width of the base 3 can therefore not lie flat against the wall of the pit 1*a* but will be supported by only a few locations with the other portions of the securing plate 8 being separated from the wall of the pit 1*a*. In order to rigidly secure the securing plate 8 to the wall of the pit 1*a* in this case, it is necessary for the anchor bolts of the fixtures 9 to be much tighter than if the entire securing plate 8 were able to lie flat against the wall. The securing plate 8 will be bent by the tightening of the anchor bolts, and the resistance to bending of the securing plate 8 will tend to pull the anchor bolts out of the wall. Thus, from the standpoint of structural strength, this means for securing the base 3 to the wall of the pit 1*a* is undesirable and potentially dangerous, as the bolts of the fixtures 9 may be torn out of the wall of the pit 1*a* by the forces acting on them.

Another problem with this conventional type of elevator will be explained with reference to FIGS. 5–7. FIG. 5 is a front vertical view of the conventional elevator apparatus of FIG. 1, showing in more detail the drum 4*a* of the hoist 4. As can be seen, the drum 4*a* has two sets of spiral rope grooves 4*b* and 4*c* formed therein which spiral from opposite ends of the drum 4*a* towards the center. A first set of rope grooves 4*b* has a first main rope 7*a* wound around it, and a second set of rope grooves 4*c* has a second main rope 7*b* wound around it. Both main ropes 7*a* and 7*b* pass over the previously-mentioned deflector sheave 6 and connect to the frame 5*a* of the elevator car 5. Elements number 12 are the landings of the building in which the hoistway 1 is provided.

As shown in FIG. 6, which is a top view of the elevator hoistway 1 taken along Line III—III of FIG. 5, due to lack of space, the deflector sheave 6 is generally not located directly above the lengthwise center of the drum 4*a* but is displaced towards one longitudinal end of the drum 4*a*. Accordingly, the angles between the longitudinal axis of the drum 4*a* and each of the main ropes 7*a* and 7*b* are not equal. This is illustrated in FIG. 7, which is a schematic view showing the geometrical relationship between the drum 4*a* and the deflector sheave 6 of the elevator of FIG. 5. In the figure, $L_0$ is the distance between the axis of the sheave 6 and the top surface of the drum 4*a*, theta 1 is the angle between the top surface of the drum 4*a* and the first main rope 7*a*, and theta 2 is the angle between the top surface of the drum 4*a* and the second main rope 7*b*. Since the sheave 6 is not centered above the drum 4*a*, the angles theta 1 and theta 2 are not equal to one another. Accordingly, the distances measured along the main ropes 7*a* and 7*b* between the sheave 6 and the drum 4*a*, which are $L_0$/sin(theta 1) and $L_0$/sin(theta 2), respectively, are not equal to one another. Thus, as the lengths are not equal, the tension applied to the two main ropes will be unbalanced, causing an overloading of the first main rope 7a with respect to the second main rope 7b or vice versa, depending on the locations of the ropes along the drum 4a. This unbalance in the main ropes will shorten their lifespan, requires the use of larger main ropes than if both main ropes carried the same load, and may even result in the breakage of the main ropes.

Another problem with this type of conventional hoist apparatus is related to the means for securing the main ropes to the drum. This problem is illustrated in FIGS. 8 through 10. FIG. 8 is a front view of one lengthwise end portion of the drum 4a of a hoist like the one illustrated in FIG. 5, FIG. 9 is a partial cross-sectional view of the same drum 4a taken along Line IV—IV of FIG. 8, and FIG. 10 is a view of the drum 4a taken along Line V—V of FIG. 9. As shown in the figures, the main rope 7a has a cylindrical stopper 14 rigidly secured to its end. The stopper 14 fits into a hole 4g formed in the wall of the drum 4a. The hole 4g connects to a groove 15 of a rope guide 15 also formed in the wall of the drum 4a, the width of the groove 15a being slightly larger than the diameter of the main rope 7a but smaller than the diameter of the stopper 14. When the stopper 14 is inserted all the way into the hole 4g, the end of the main rope 7a contacts the inner surface of the groove 15a, and when tension is applied to the rope 7a, the top surface of the stopper 14 is forced firmly against the bottom surface of the rope guide 15. The other main rope 7b is connected to the drum 4a in a similar manner.

There is no problem with this manner of connection when the main ropes 7a and 7b are tautly wound around the drum 4a. However, if the elevator car 5 should reach the end of its travel and contact the unillustrated buffers generally provided in the pit 1a of the elevator hoistway 1, the main ropes will become slack and there will be no force preventing the stopper 14 from coming out of the hole 4g in the drum 4a. Accordingly, before the elevator car 5 can be allowed to again travel up the hoistway 1, it is necessary to check whether the stopper 14 is in fact securely held inside the drum 4a. This means for securing the ends of the main ropes is therefore is disadvantageous from the standpoint of safety.

As explained above, there is therefore a need for an improved elevator hoist apparatus which is better secured to the hoistway in which it is installed and which has a safer drum.

SUMMARY OF THE INVENTION

It is the object of the present invention to overcome the above-described drawbacks of conventional elevator hoists and to provide an elevator hoist apparatus which can be more safely secured to the wall of an elevator hoistway, even when the wall of the hoistway to which it is secured is not smooth.

It is another object of the present invention to provide an elevator hoist apparatus which can be easily installed in a hoistway.

It is a further object of the present invention to provide an elevator hoist apparatus which protrudes less into an elevator hoistway than a conventional hoist.

It is another object of the present invention to provide an elevator hoist apparatus which uses fewer parts to secure it to the wall of the hoistway.

It is yet another object of the present invention to provide an elevator hoist apparatus which has an improved hoist drum which will allow the load of the elevator car to be equally carried by the elevator main ropes.

It is still another object of the present invention to provide an elevator hoist apparatus which employs an improved, safer means for securing the ends of elevator main ropes to the drum of the apparatus.

In the present invention, holes are provided in the top portion of a securing plate for securing the base of the hoist apparatus to the wall of the elevator hoistway. The ends of the base of the hoist apparatus pass through these holes and are secured thereto. In this manner, the base can be simply secured to the securing plate while reducing the length by which the base protrudes into the hoistway. The securing plate can be divided in the widthwise direction into a plurality of narrower parallel securing plates which, because of their narrowness, can be rigidly secured to the wall of a hoistway, even when the wall has an uneven surface. The present invention also includes an improved hoist drum which has double, parallel rope grooves spiralling around the drum in the same direction from one end of the drum to the other. Since the main ropes wound around the drum are parallel, their lengths are always equal, and they therefore equally bear the load of the elevator car which they support. Furthermore, the present invention includes an improved means for securing the ends of the main ropes to the drum which employs U-bolts which fit around stoppers attached to the ends of the main rope and which bolt to the end plates secured to the end of the hoist drum. Because the stoppers are securely grasped by the U-bolts regardless of whether there is an tension applied to the main ropes, there is no danger of the ends of the main ropes coming out of the drum when the elevator main ropes become slack.

Accordingly, the present invention is an elevator hoist apparatus for use in an elevator hoistway having a machine room provided above the pit portion of the hoistway which opens onto the hoistway, comprising a hoist, a base on which the hoist is rigidly mounted, and plate-like securing means for securing the base to the wall of the hoistway just below the machine room, the securing means having a base-securing hole formed therein near its upper end, the securing means being secured to the wall of the hoistway just below the machine room, one end of the base passing through the base-securing hole and being rigidly connected to the securing means.

The hoist further comprises a hoist drum which preferably has a plurality of parallel rope grooves formed in its outer circumference which spiral from one end of the drum to the other.

It further comprises a plurality of main ropes connected at one end to the hoist drum by rope securing means which preferably comprises a cylindrical stopper which is secured to one end of a main rope and which has a circumferential groove formed in its outer surface, a rigid end plate secured to the end surface of the drum, and a U-bolt which fits around the circumferential groove in the main rope stopper and is rigidly secured to the end plate.

BRIEF DESCRIPTION OF THE DRAWINGS

In all of the drawings, identical or corresponding elements are indicated by the same reference numerals.

DESCRIPTION OF THE PREFERRED EMBODIMENTS

Hereinbelow, a number of preferred embodiments of the present invention will be described while referring to FIGS. 11 through 22.

Figure 1:
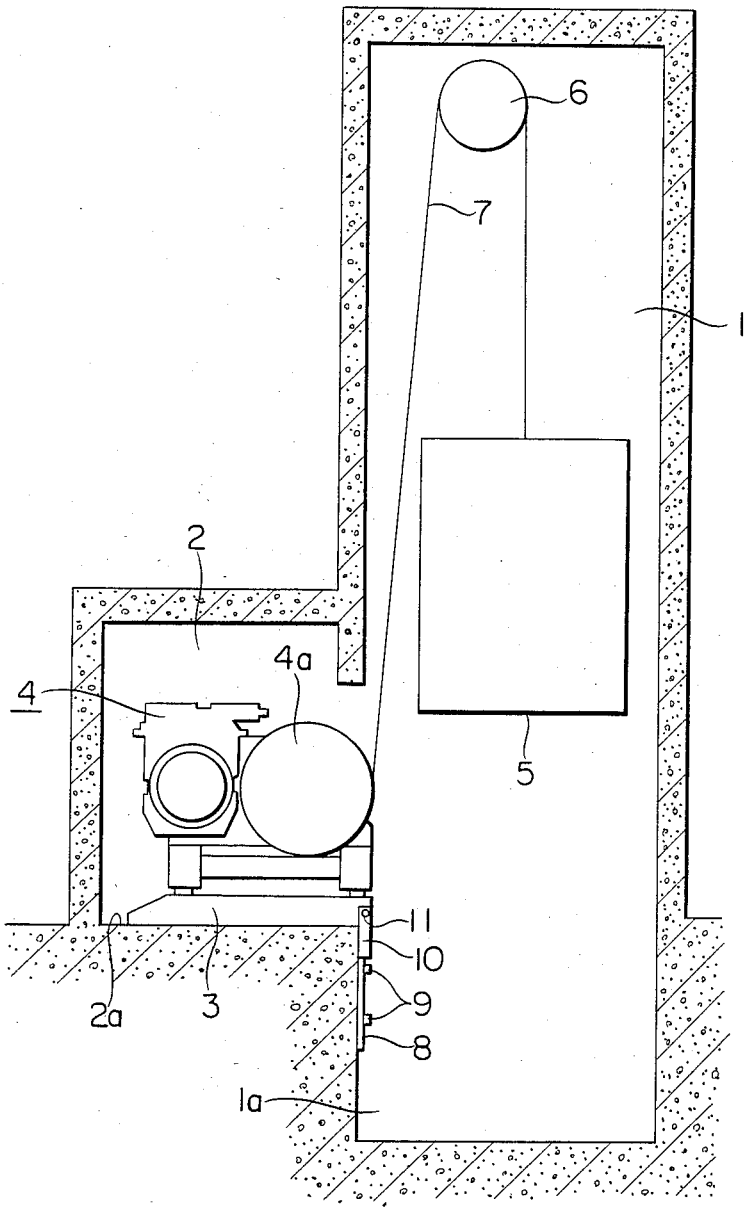
FIG. 1 PRIOR ART
FIG. 1 is a vertical profile of a conventional elevator hoist apparatus installed at the bottom of a hoistway.
Figure 2:
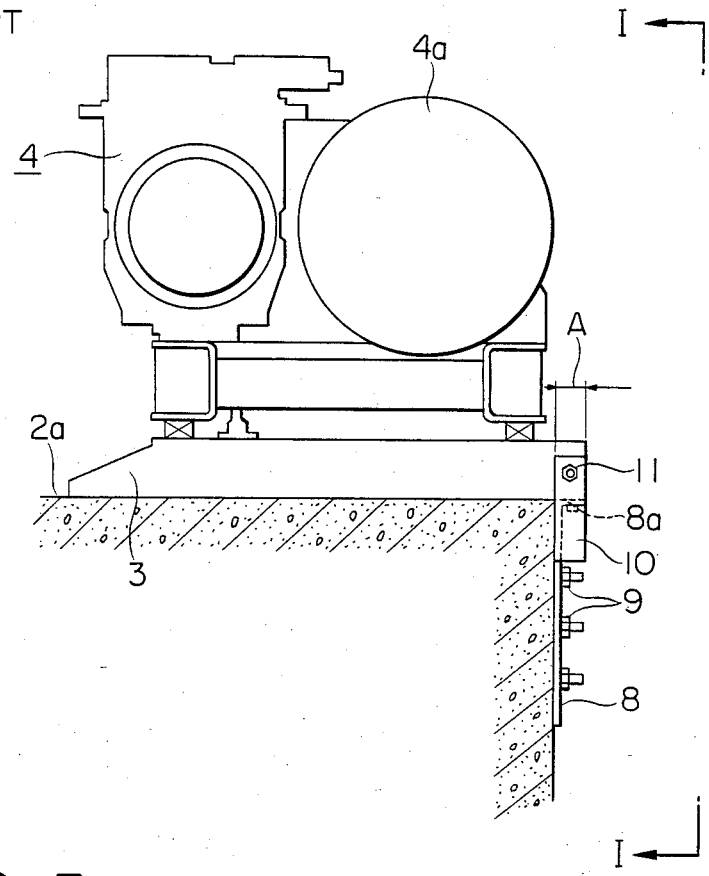
FIG. 2 PRIOR ART
FIG. 2 is an enlarged view of the elevator hoist apparatus of FIG. 1, showing the method of connecting the hoist to the wall of the hoistway.
Figure 11:
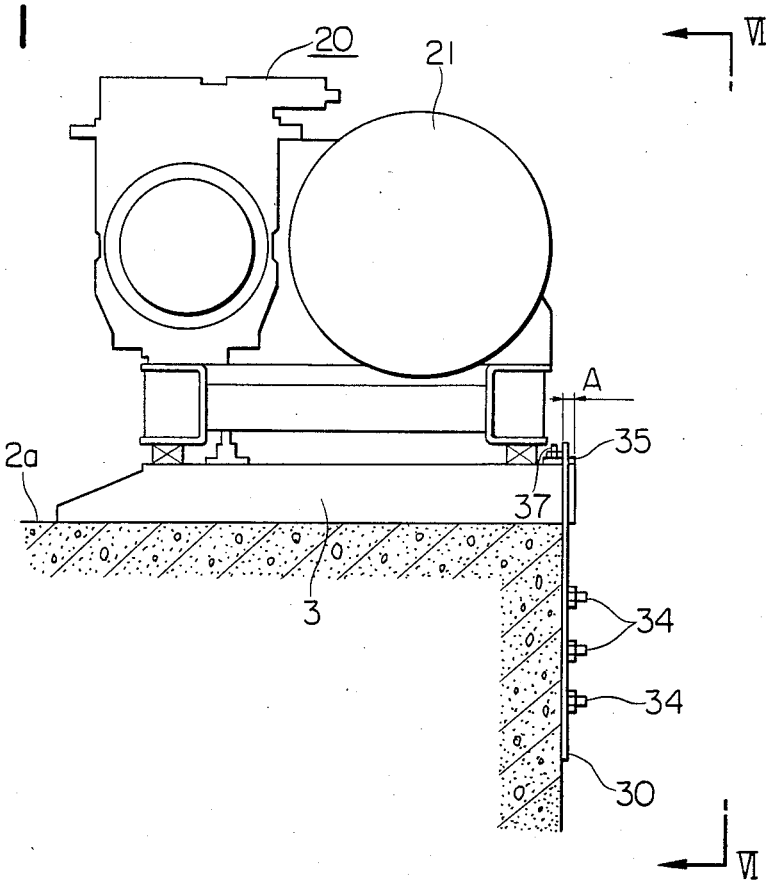
FIG. 11 is a partially schematic vertical profile of an embodiment of an elevator hoist apparatus according to the present invention.
Figure 12:
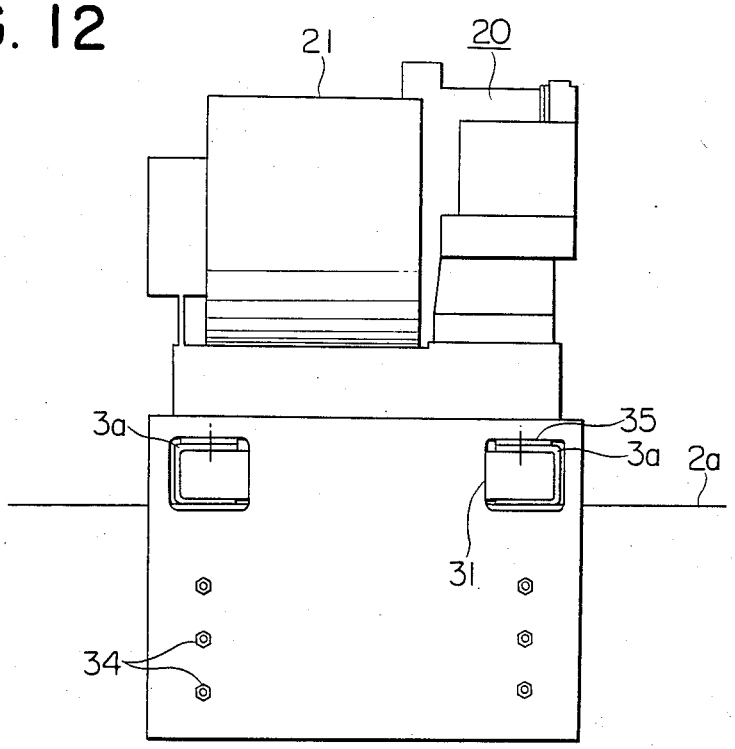
FIG. 12 is another view of the embodiment of FIG. 8 taken along Line VI—VI of FIG. 11.
Figure 13:
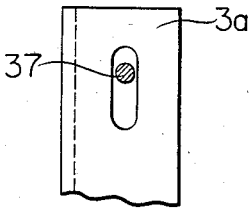
FIG. 13 is plan view of one of the ends of the base of the apparatus of FIG. 11.

FIGS. 11 through 13 show a first embodiment of the present invention, with the hoist indicated schematically. Like the conventional hoist apparatus of FIG. 1, the present hoist apparatus comprises a hoist 20 having an unillustrated motor, an unillustrated reduction gear driven thereby, and a hoist drum 21 mounted on the output shaft of the reduction gear, a base 3 comprising a plurality of beams 3*a* secured to the floor 2*a* of a machine room 2, and means for rigidly attaching the end of the base 3 to the wall of the pit 1*a* of the hoistway 1 just below the machine room 2. The means for rigidly attaching the hoist apparatus to the wall of the hoistway will be first described, and the other portions of the apparatus which are indicated schematically in these figures will be described in greater detail further on. It can be seen from the figures that the means by which the base 3 of the hoist 4 is secured to the wall of the pit 1*a* of the hoistway 1 is completely different from in the conventional apparatus of FIGS. 2 and 3. Namely, in the present invention, a plate-like securing means, i.e., a securing plate 30 is secured to the wall of the pit 1*a* by fixtures 34 comprising nuts and anchor bolts or the like has base-securing holes 31 formed in its upper end. The size of and the spacing between the holes 31 corresponds to the size of and the spacing between the two beams 3*a* which form the base 3 for the hoist 3 so that the beams 3*a* can pass through the holes 31. A metal connecting plate 35 is provided for connecting each beam 3*a* to the securing plate 30. One end of each connecting plate 35 is welded to the top inside surface of a corresponding hole 31, and the other end of the connecting plate 35 is rigidly connected to the corresponding beam 3*a* by fixtures 37 comprising nuts and bolts or the like which pass through holes formed in the connecting plate 35 and the beams 3*a*. As shown in FIG. 13, the holes in the connecting plates 35 through which the bolts of the fixtures 37 pass are elongated in the lengthwise direction of the beams 3*a*. By means of these elongated holes, the connecting plates 35 can be more easily connected to the beams 3*a* than if the holes were round. It is of course possible to elongate the corresponding holes formed in the connecting plates 35 instead of the holes formed in the beams 3*a* and achieve the same effect.

As shown in FIG. 11, since the beams 3*a* are connected to the securing plate 30 on the side facing into the machine room 2 rather than on the side facing the hoistway 1, the distance A by which the beams 3*a* of the base 3 protrude into the hoistway 1 can be considerably reduced, thereby making it easier to install an elevator in a narrow hoistway.

Figure 4:
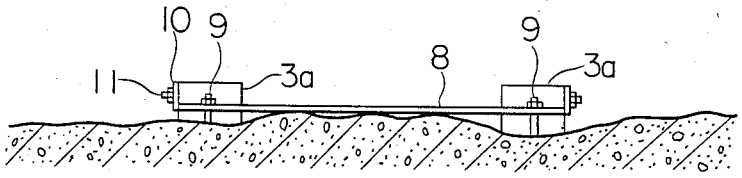
FIG. 4 PRIOR ART
FIG. 4 is a view of the securing plate of the apparatus of FIG. 3 taken along Line II—II of FIG. 3.
Figure 9:
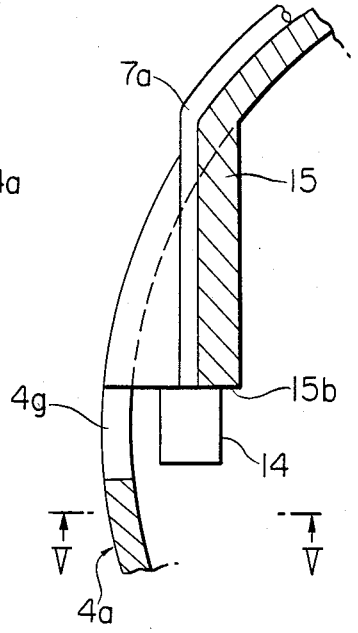
FIG. 9 PRIOR ART
FIG. 9 is a vertical profile partially in cross section of the drum shown in FIG. 8 taken along Line IV—IV of FIG. 8.
Figure 10:
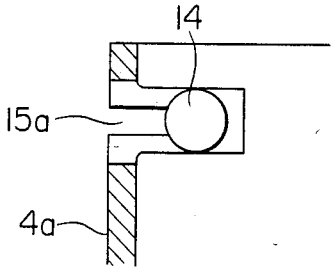
FIG. 10 PRIOR ART
FIG. 10 is a cross-sectional view of the drum in FIG. 9 taken along Line V—V of FIG. 9.
Figure 14:
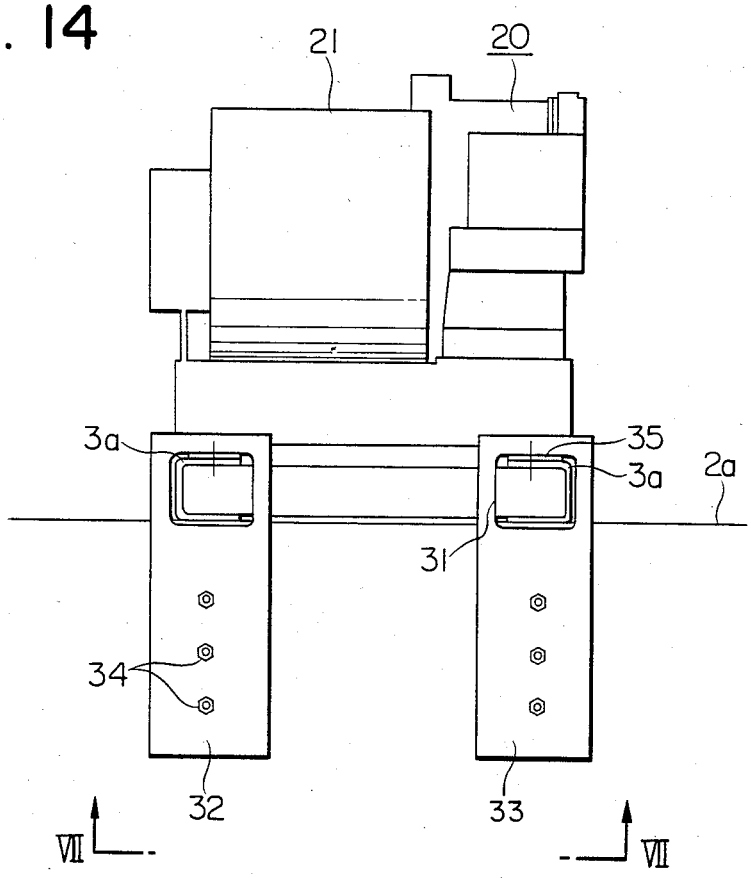
FIG. 14 is a partially schematic front elevation of another embodiment of an elevator hoist apparatus according to the present invention.
Figure 15:
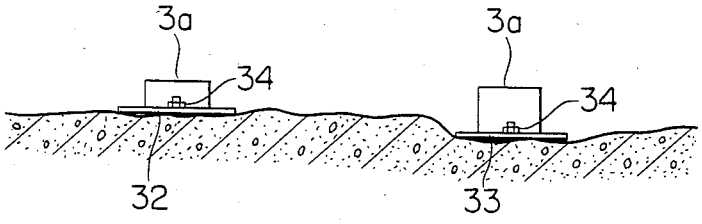
FIG. 15 is a view of the embodiment of FIG. 14 taken along Line VII—VII of FIG. 14.

FIG. 14 shows another embodiment of an elevator hoist apparatus according to the present invention. This embodiment differs from that of FIG. 12 in that the single, wide securing plate 30 of FIG. 12 is divided into two narrow securing plates 32 and 33 having base-securing holes 31 formed therein, each of which is secured to the wall of the pit 1*a* by fixtures 34 and each of which is secured to the beams 3*a* of the base 3 in the same manner as is the securing plate 30 of FIG. 9. FIG. 15 shows a view of this embodiment taken along Line VII—VII of FIG. 14. As can be seen from FIG. 15, dividing the securing plate 30 into two independent narrow securing plates 32 and 33 provides the very important advantage that both securing plates can be independently moved along the beams 3 until they both rest flat against the wall of the pit 1*a* of the hoistway 1 even when the wall is very uneven. The securing plates 32 and 33 are thus better supported by the wall, and they can be rigidly secured to the wall of the pit 1*a* by employing much less tightening force on the bolts of the fixtures 34. Furthermore, since the securing plates 32 and 33 are not subjected to bending like the securing plate illustrated in FIG. 4, the forces tending to pull the anchor bolts of the fixtures 34 out of the wall of the pit 1*a* are much lower than for the conventional hoist apparatus. Accordingly, this embodiment is much superior from a structural standpoint.

Although FIG. 14 illustrates two securing plates 32 and 33, there is no particular limitation on the number. If the base 3 comprises three or more beams 3*a*, a corresponding number of securing plates can be used.

In both of these embodiments, the dimensions of the base 3 only have to be precise enough that the beams 3*a* of the base 3 can pass through the holes in the top portion of the securing plate(s). The widthwise dimensions of the base 3 and of the securing plate(s) therefore do not have to be exact, and their manufacture and assembly is easier than for the conventional apparatus of FIG. 3.

Figure 3:
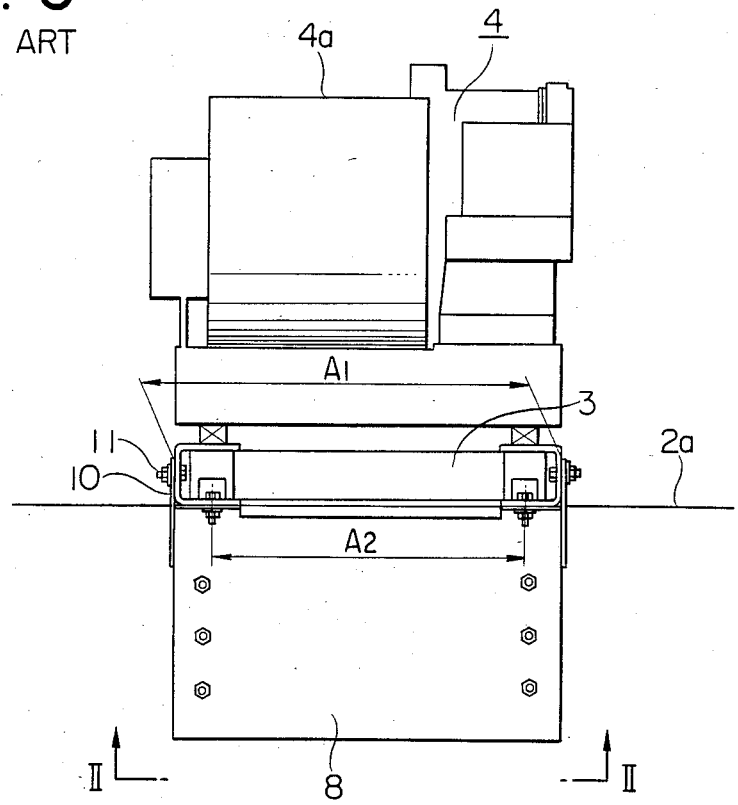
FIG. 3 PRIOR ART
FIG. 3 is a view of the conventional elevator hoist apparatus of FIG. 2 taken along Line I—I of FIG. 2.

In addition, in both of these embodiment, any upward forces exerted on the base 3 are transmitted to the securing plate(s) at the top surfaces of the holes 31, with the load being distributed over a broad area of the securing plate(s) rather than being transmitted via the connecting plates 10 and fixtures 9 as in FIG. 3, in which the load is distributed over a smaller area. The stresses applied to the securing plate(s) as well as to the connecting plates 35 are therefore lower, and a reduction in size and weight can be achieved.

Figure 16:
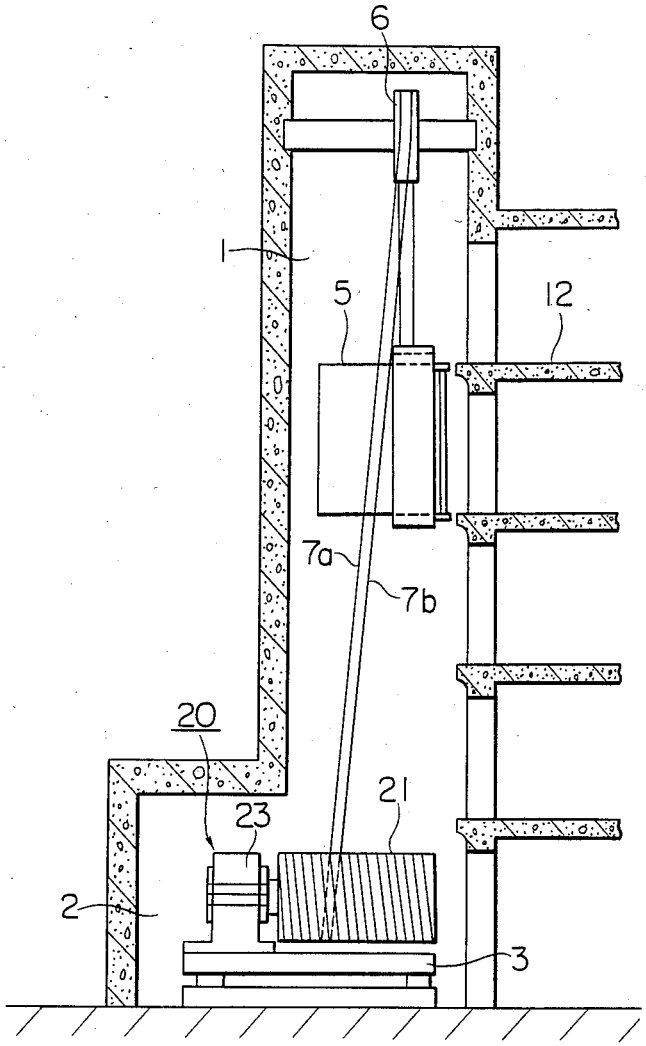
FIG. 16 is a front elevation similar to FIG. 5, illustrating the relationship of the hoist apparatus of the present invention to the elevator hoistway.
Figure 17:
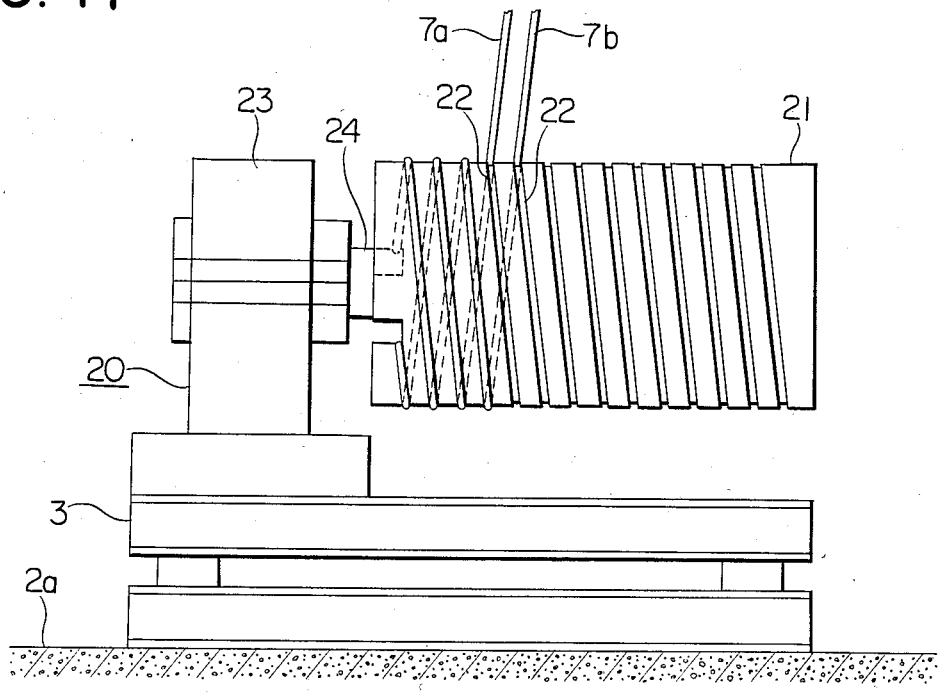
FIG. 17 is an enlarged view of a portion of the apparatus illustrated in FIG. 16, showing the details of the hoist drum.

FIG. 16 is a front elevation of a hoist apparatus according to the present invention installed in the machine room 2 of a hoistway 1. The hoist 20 is secured to the wall of the pit 1*a* of the hoistway 1 in the manner of either of the previous two embodiments, and accordingly the connections between the hoist apparatus and the wall of the pit 1*a* are not illustrated. In the present invention, the drum 21 of the hoist 20 is formed with double, parallel rope grooves 22 which spiral around the drum 21 in the same direction rather than in opposite directions as in the conventional hoist apparatus. The drum 21 is shown most clearly in FIG. 17. Two parallel rope grooves 22 formed in the drum 21 spiral around the drum 21 from the end near the reduction gear 23 of the hoist 20 to the opposite end. The first main rope 7*a* is wound around one of the rope grooves 22 and the second main rope 7*b* is wound around the other of the grooves 22 so that the two main ropes 7*a* and 7*b* are always parallel.

Figure 5:
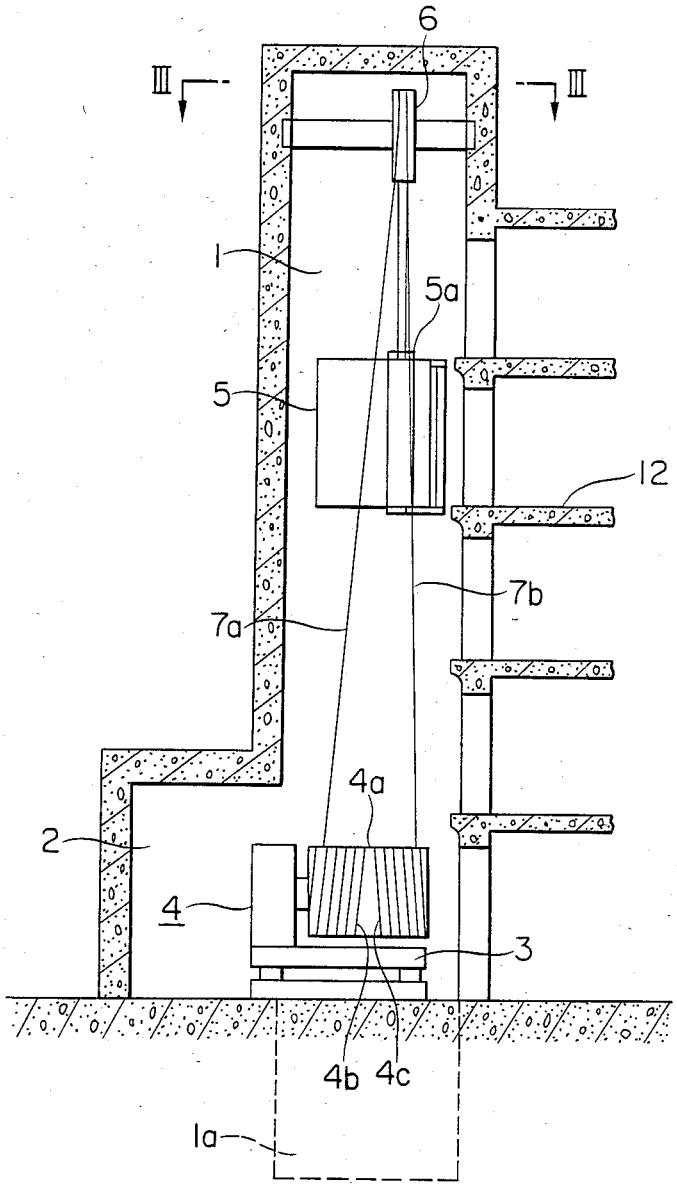
FIG. 5 PRIOR ART
FIG. 5 is a front elevation of a conventional elevator hoist apparatus installed in an elevator hoistway, showing how the main ropes are wound around the drum of the hoist.
Figure 6:
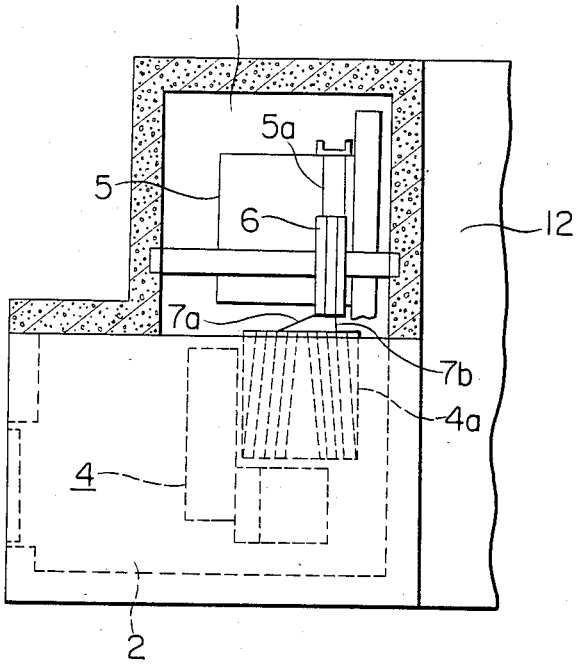
FIG. 6 PRIOR ART
FIG. 6 is a view of the conventional apparatus of FIG. 5 taken along Line III—III of FIG. 5.
Figure 7:
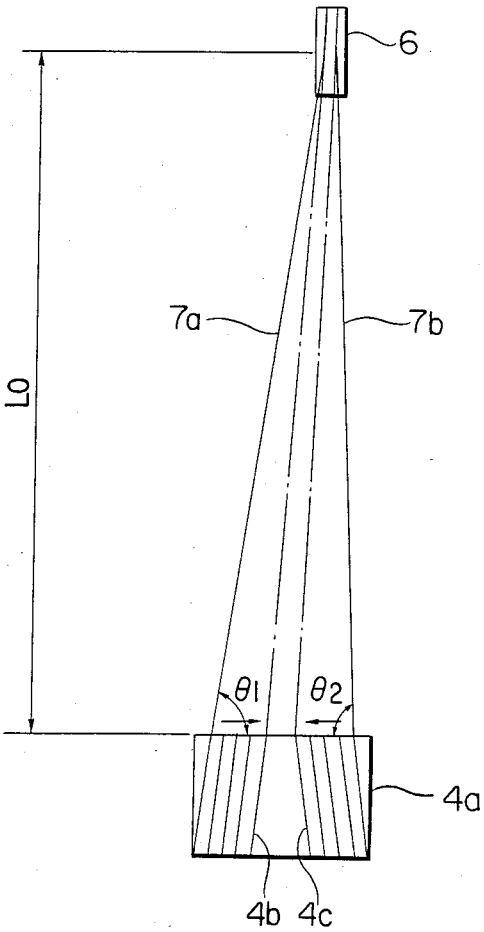
FIG. 7 PRIOR ART
FIG. 7 is a schematic of the hoist drum and the deflector sheave of a conventional elevator hoist apparatus, illustrating the geometrical relationship therebetween.
Figure 8:
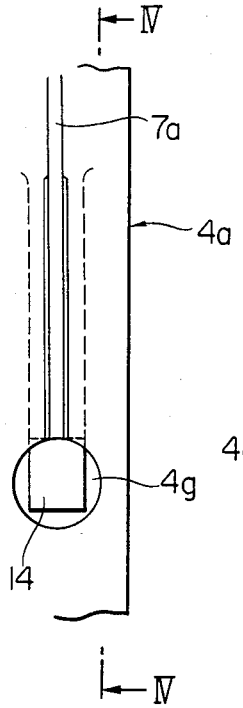
FIG. 8 PRIOR ART
FIG. 8 is a front elevation of a portion of the drum of a conventional hoist apparatus, showing the method of connecting the end of the main rope to the drum.
Figure 18:
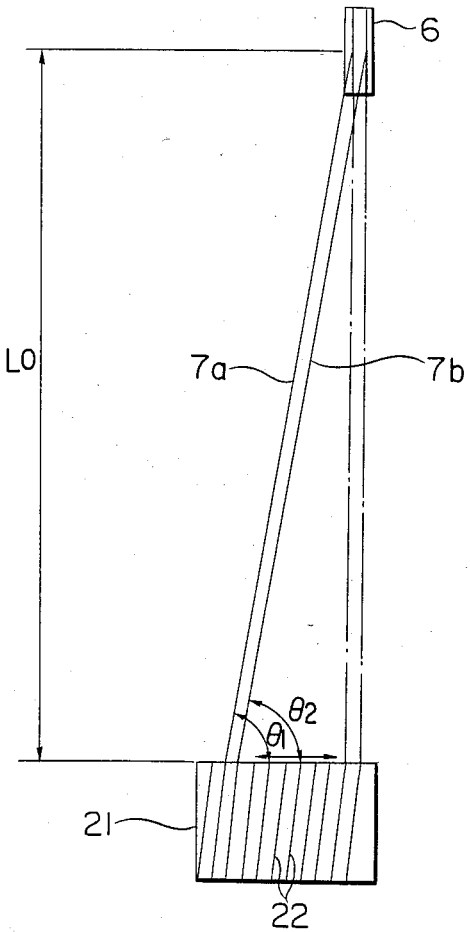
FIG. 18 is a schematic similar to FIG. 7, showing the geometrical relationship between the drum and the deflector sheave according to the apparatus of FIG. 16.
Figure 19:
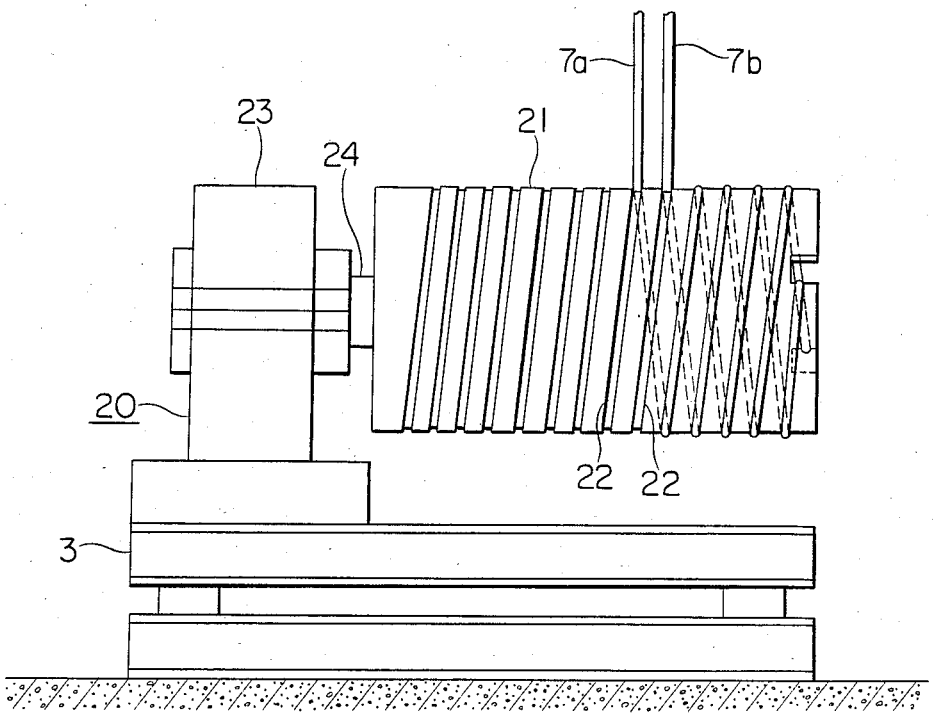
FIG. 19 is a vertical profile similar to FIG. 17 of the hoist drum in another embodiment of the present invention, in which the main ropes are secured to the end of the drum which is removed from the reduction gear of the hoist.

FIG. 18 schematically shows the geometrical relationship between the main ropes 7*a* and 7*b* and the drum 21 of the hoist 20. As shown in the figure, since the main ropes 7*a* and 7*b* are always parallel to one another, the angles theta 1 and theta 2 between the drum 21 and the main ropes 7*a* and 7*b*, respectively, are equal to one another, and the lengths of the main ropes 7*a* and 7*b* are also equal to one another. Thus, unlike the conventional hoist apparatus illustrated in FIG. 7, the load of the elevator car 5 is carried equally by the two main ropes, and the maximum stress applied to either of the main ropes is decreased. Since there is no overloading of the main ropes, this embodiment provides increased safety, enables a longer lifespan for the main ropes, prevents damage to the main ropes and to the drum 21 due to overloading, and prevents the vibration of the elevator car 5 which occurs with the conventional hoist apparatus illustrated in FIG. 5.

Although in the figures only two main ropes are illustrated, the number of main ropes is not limited to just two. Three or more main ropes can be wrapped around a corresponding number of parallel rope grooves which spiral from one end of the drum 21 to the other.

In FIG. 18, the rope grooves 22 formed in the drum 21 spiral around the drum 21 in the form of right-hand screw threads, and the main ropes 7*a* and 7*b* are connected to the drum 21 at the end nearest to the reduction gear 23 of the hoist 20. However, depending on the dimensions of the drum 21 and the length of the output shaft 24 on which it is mounted, it may be difficult to connect the main ropes 7*a* and 7*b* to the drum 4*a* because of too little room between the end of the drum 21 and the reduction gear 23. Accordingly, in another embodiment of the present invention illustrated in FIG. 19, the double rope grooves 22 have the form of left-hand screw threads, and both of the main ropes 7*a* and 7*b* are secured to the drum 21 at the end which is distant from the reduction gear 23. This provides more working room and it is thus easier to install the main ropes 7*a* and 7*b*. As with the previous embodiment, the number of main ropes is not limited to two. By providing three or more parallel rope grooves which spiral in the manner of left-hand screw threads from one end of the drum to the other, a corresponding number of main ropes can be used.

Figure 20:
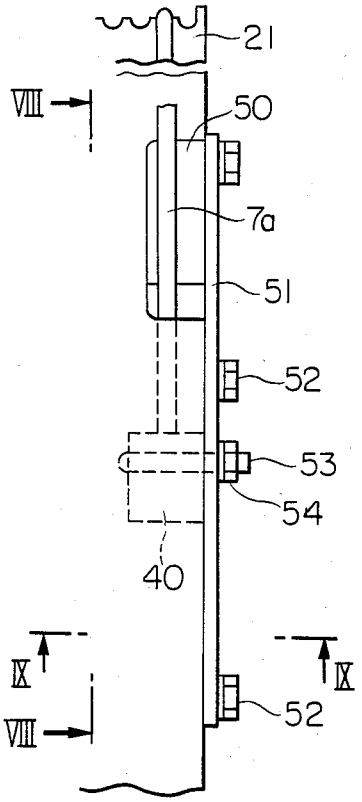
FIG. 20 is a front elevation of the end of the hoist drum of the apparatus according to the present invention.
Figure 21:
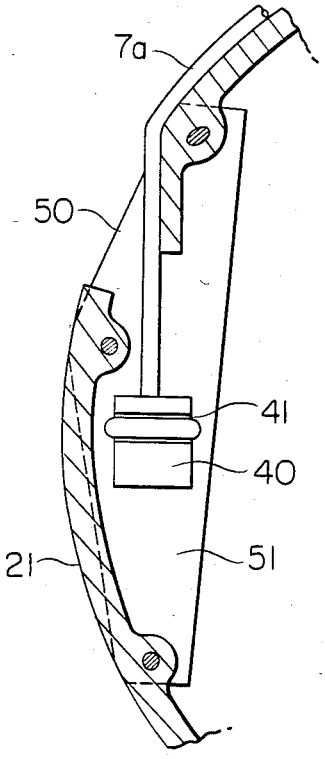
FIG. 21 is a view of the drum of FIG. 20 taken along Line VIII—VIII of FIG. 20.
Figure 22:
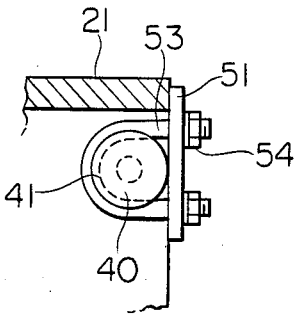
FIG. 22 is view of the hoist drum of FIG. 20 taken along Line IX—IX of FIG. 20.

FIGS. 20 through 22 illustrate the novel means for connecting the ends of the main ropes 7*a* and 7*b* to the drum 21 in any of the previously-described embodiments of the present invention. Although the figures illustrate only the first main rope 7*a*, the same means is used for securing the second main rope 7*b*. FIG. 20 is a fragmentary top plan view of one end of the drum 21 of a hoist apparatus according to the present invention, showing the means for connecting the main ropes 7*a* and 7*b* to the drum 21, FIG. 21 is a view taken along Line VIII—VIII of FIG. 20, and FIG. 22 is a view taken along Line IX—IX of FIG. 20. The circumferential wall of the drum 21 has a hole 50 formed in it which opens onto the outer periphery of the drum 21 and onto the longitudinal end of the drum 21. One end of main rope 7*a*, which has a cylindrical stopper 40 secured to it, passes through the hole 50 so that the stopper 40 is located inside of the drum 21. A rigid end plate 51 is rigidly secured to the end surface of the drum 21 by fixtures 52 comprising nuts and bolts or the like. The stopper 40 is rigidly secured to the end plate 51 by a U-bolt 53 which fits tightly around a circumferential groove 41 formed in the stopper 40. The ends of the U-bolts 53 pass through corresponding holes formed in the end plate 51 and are fitted with nuts 54 so that the stopper 40 is held tightly to the end plate 51. The hole 50 in the wall of the drum 21 need have no particular shape and only need be large enough for the rope 7*a* to pass through.

It can be seen that with this arrangement, the end of the main rope 7*a* is reliably secured to the end of the drum 21 via the U-bolt 53 and the end plate 51 regardless of whether tension is applied to the main rope 7*a*. Therefore, if the elevator car 5 contacts the buffers in the pit 1*a* of the hoistway 1 and the main ropes become slack, it is not necessary to check whether the ends of the main ropes have become disconnected from the drum 21. Furthermore, it can be seen that whereas the main rope connecting means illustrated in FIG. 16 requires a rope guide 15 having a complicated shape and a hole 4*g* conforming to the shape of the stopper 14 to be cut in the drum 4*a*, the hole 50 in the drum 4*a* in the present invention need have no prescribed shape and is of very simple form, and can thus be very easily formed. The same applies for the end plate 51.

Although explanation was made with respect to a drum holding two main ropes, the number of main ropes which can be installed on a drum 21 in this manner is of course not limited to two.

What is claimed is:

1. An elevator hoist apparatus for use in an elevator hoistway having a machine room provided above the pit portion of the hoistway which opens onto said hoistway, comprising:

a hoist;

a base on which said hoist is rigidly mounted; and plate-like securing means for securing said base to the wall of said hoistway just below said machine room, said securing means having a base-securing hole formed therein near its upper end, said securing means being secured to the wall of said hoistway just below said machine room, one end of said base passing through said base-securing hole and being rigidly connected to said securing means.

2. An elevator hoist apparatus as claimed in claim 1, wherein:

said base comprises a plurality of beams rigidly secured to the floor of said machine room;

said base-securing holes are equal in number to said beams;

one end of each of said beams passes through a corresponding one of said base-securing holes and is secured to said securing means.

3. An elevator hoist apparatus as claimed in claim 1, wherein said base is secured to said securing means on the side of said securing means facing said machine room.

4. An elevator hoist apparatus as claimed in claim 1, further comprising a connecting plate which extends towards the inside of said machine room, one end of said connecting plate being connected to the inside of said base-securing hole and the other end of said connecting plate being connected to said base.

5. An elevator hoist apparatus as claimed in claim 2, wherein said securing means comprises a single plate.

6. An elevator hoist apparatus as claimed in claim 2, wherein said securing means comprises a plurality of plates corresponding in number to said beams of said base, each of said beams being connected to a corresponding securing plate.

7. An elevator apparatus as claimed in claim 1, wherein:

said hoist comprises a hoist motor, a reduction gear which has an output shaft and which is connected to said hoist motor so as to be driven thereby, a hoist drum mounted on said output shaft, a plurality of main ropes connected at one end of said hoist drum, and means for connecting said ends of said main ropes to said hoist drum; and said hoist drum has a plurality of parallel rope grooves formed in its outer circumference which spiral from one end of said drum to the other.

8. An elevator hoist apparatus as claimed in claim 6, wherein said hoist drum has a hole which opens onto one of its longitudinal ends formed therein, and said means for securing said main ropes comprises:

a cylindrical rope stopper which is secured to one of each of said main ropes and which has a circumferential groove formed in its outer surface;

a rigid end plate secured to the end surface of said drum; and a U-bolt which fits around said circumferential groove in said rope stopper and is rigidly secured to said end plate.

* * * * *